United States Patent [19]

Leppers et al.

[11] Patent Number: 4,495,390

[45] Date of Patent: Jan. 22, 1985

[54] DISCONNECT SWITCH

[75] Inventors: P. H. Leppers, Maastricht, Netherlands; Walter Schnoor, Essen, Fed. Rep. of Germany

[73] Assignee: Ruhrtal Elektrizitätsgesellschaft Hartig GmbH & Co., Essen, Fed. Rep. of Germany

[21] Appl. No.: 534,583

[22] Filed: Sep. 22, 1983

[51] Int. Cl.[3] ..... H01H 9/40

[52] U.S. Cl. ..... 200/145; 200/48 V; 200/146 R

[58] Field of Search ..... 200/48 V, 48 SB, 48 CB, 200/145, 146 R

[56] References Cited

FOREIGN PATENT DOCUMENTS

| | | | |
|---|---|---|---|
| 2809499 | 9/1979 | Fed. Rep. of Germany . | |
| 2847377 | 10/1979 | Fed. Rep. of Germany . | |
| 2839914 | 3/1980 | Fed. Rep. of Germany . | |
| 443440 | 8/1966 | Switzerland | 200/48 V |

*Primary Examiner*—John W. Shepperd
*Assistant Examiner*—Renee Kidorf
*Attorney, Agent, or Firm*—Karl F. Ross

[57] ABSTRACT

A switch for making and breaking a connection between a load circuit and a power line includes a stationary metal bar mechanically and conductively connected to the power line and a scissorlike contactor pair gripping the bar in a closure position. The bar is flanked by two metallic guard elements in the shape of elastic rods that are first engaged by the contactors upon closure and last disengaged from them upon opening of the switch. In the closure position, in which the contactors also engage the bar, the two rods are connected to that bar through a circuit breaker formed by two metallic spurs which separate during a disconnect operation after the contactors have disengaged the bar but while they are still in engagement with the rods whereby any arcing will occur only between scorchproof contact zones of these spurs. The circuit breaker is shunted by a high-ohmic bypass which is cut out in the closure position of the switch and is cut in substantially simultaneously with the separation of the two spurs from each other.

17 Claims, 3 Drawing Figures

DISCONNECT SWITCH

FIELD OF THE INVENTION

Our present invention relates to an electrical disconnect switch of the type designed to isolate a power line from a load circuit upon separation of a movable contact element from a stationary contact element normally engaged thereby.

BACKGROUND OF THE INVENTION

Switches of this type are usually disposed in series with a power switch in the load circuit so that their own contact-closing and contact-opening operations occur under virtual open-circuit conditions. A group of such switches may be used, for example, to connect the open power switch to any one of several associated supply lines in order to establish a selected current path for a given load. These switches also serve to indicate, by their readily observable position, whether or not a particular circuit is connected to the power line or disconnected therefrom.

Even though a switch of the kind here considered opens and closes in the absence of load current, it may still be traversed by residual commutation or capacitive currents at relatively low voltage giving rise to unavoidable arcing on the opening stroke. When closed, the switch must be able to carry not only the normal load current but also, in the event of a short circuit, a greatly increased current which flows until the associated power switch is opened.

In the closure position of the switch, the load current flows through relatively displaceable first and second metallic terminal members which should engage each other with a minimum contact resistance. It is therefore important to protect their contact surfaces against erosion due to arcing, and it is known to provide these terminal members for that purpose with metallic guard elements of lesser cross-section which carry but a small fraction of the load current and become disengaged only after the two terminal members have become separated on moving into a disconnect position. Since these guard elements are the first to engage each other upon reclosure of the switch, any arcing on opening or closure will occur between them only. A simpler arrangement of this character comprises just one metallic guard element electrically and mechanically connected with the first terminal member and positioned to be engaged prior to that terminal member by the second terminal member upon closure, any arcing being limited in that instance to the zone of engagement between the guard element and the second terminal member.

Such an assembly of conductive elements is known, for example from German laid-open application No. 28 09 499 which discloses a so-called one-column disconnect switch wherein the first terminal member is a horizontal metal bar suspended from a power line while two second terminal members are constituted by a pair of scissorlike contactors gripping that bar in the closure position. The scissor linkage is displaceably mounted on a ceramic column and its contactors, in one particular instance, are receivable between two converging wire loops that are conductively connected to opposite ends of the bar and serve as guard elements therefor. A similar one-column disconnect switch, disclosed in German laid-open application No. 28 39 914, has the contactors of its scissor linkage equipped with guard elements in the form of slender rods which are resiliently supported thereon and coact with similar rods resiliently supported on the metallic bar to be gripped by these contactors. A switch assembly of the same general type is the subject matter of German laid-open application No. 28 47 377.

In all these instances the conductive guard elements lie so close to the associated terminal members—as is necessary to limit the opening and closure strokes of the switch—that there is a danger of the arc jumping over to these terminal members. With a disconnect switch serving an outdoor power line, such as the one-column switches referred to, this risk is intensified by the possibility that a gust of wind may drive a guard element toward ics supporting terminal member.

OBJECTS OF THE INVENTION

An important object of our present invention, therefore, is to provide an improved conductor assembly for a disconnect switch of the type here considered in which the danger of arcing at either of the coacting terminal members is eliminated.

A more particular object is to provide an assembly of this nature which avoids the need for providing both terminal member with guard elements.

SUMMARY OF THE INVENTION

In accordance with our present invention, we insert circuit-breaker means between the first terminal member and an associated guard element, yieldably interposed between the two terminal members, for establishing conductive contact between the guard element and the first terminal member in response to its initial displacement by the second terminal member before the latter engages the first terminal member upon relative motion into a closure position. Two coacting conductors forming part of the circuit-breaker means separate, upon reverse motion of the terminal members into a disconnect position, after disengagement of these terminal members from each other but before loss of contact between the guard element and the second terminal member.

Thus, the connection established by the switch between a power line and a load circuit is broken at the conductors of the circuit-breaker means, rather than at the point of engagement between the guard element and the second terminal member, when the switch is being opened; any arcing will therefore be limited to confronting contact zones of these coacting conductors which preferably are made of or coated with scorchproof metallic material, e.g. silver/cesium oxide.

Since in the disconnect position the guard element is electrically separated by the circuit-breaker means from the associated terminal member, it could tend to develop a floating potential creating discharges between that element and its terminal member. In order to prevent this from happening, another advantageous feature of our invention resides in the provision of bypass means in shunt with the circuit-breaker means and mechanically coupled therewith so as to be cut out upon approach of the closure position of the switch and cut in upon approach of its disconnect position. To prevent a short-circuiting of the circuit-breaker means by the bypass means before the second terminal member has disengaged the guard element, the bypass means may be cut in with a certain delay; we prefer, however, to give this bypass a high-ohmic character instead. Thus, the bypass means may comprise two conductive pieces which come into contact with each other in the disconnect position of the switch and at least one of which consists of a material of high resistivity advantageously a metallized elastomeric material. The interengagement of these conductive pieces can also serve to limit the displacement of the guard element away from its terminal member, under the urging of a biasing spring or the like, so as to establish a limiting position for that element.

In principle, it is immaterial whether the terminal member associated with the guard element is connected to the power line or to the load circuit. In the case of a scissor-type disconnect switch as discussed above and as more particularly described hereinafter, however, it will be convenient to designate the metallic bar suspended from the power line as the first terminal member while the pair of contactors of the scissor linkage constitute two symmetrical second terminal members, the assembly therefore comprising two metallic guard elements advantageously designed as a pair of rods paralleling the bar on opposite sides thereof. Each rod may be pivotally mounted on a frame which in a simple case merely consists of two dielectric brackets attached to opposite extremities of the bar. Each bracket preferably is in the form of a pair of clamping jaws whereby these rods may be readily coupled with or decoupled from the associated bar. It will be convenient in such a case to mount the circuit-breaker means and the bypass means according to our invention at opposite ends of the frame.

BRIEF DESCRIPTION OF THE DRAWING

The above and other features of our invention will now be described in detail with reference to the accompanying drawing in which.

SPECIFIC DESCRIPTION

Figure 1:
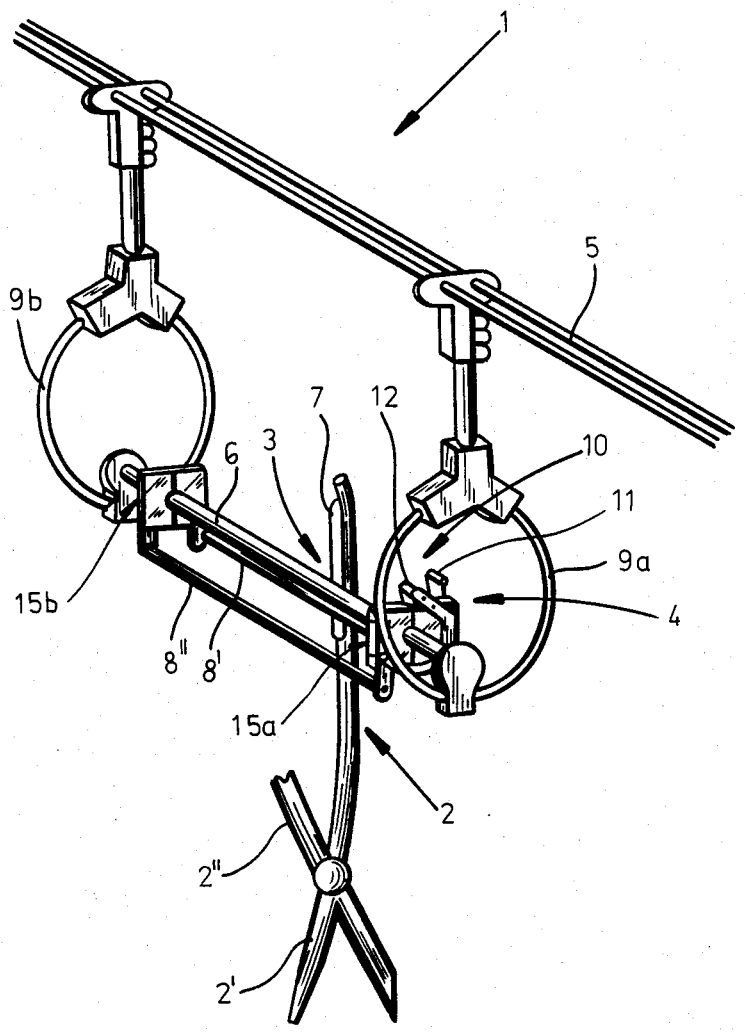
FIG. 1 is a perspective view of a significant part of a disconnect switch provided with a conductor assembly according to our invention.

In FIG. 1 we have shown a disconnect switch 1 including a scissor linkage 2 with a pair of metallic prongs 2', 2'' (the latter being illustrated only in part) which carry respective face plates 7 designed to grip a metallic bar 6 between them in a closure position of the switch. Prongs 2', 2'' may be one of two pairs of parallel contactors engageable with bar 6 at spaced-apart locations, e.g. as shown in commonly owned application Ser. No. 476,358 filed Mar. 17, 1983 by Alfred Hartig. Bar 6 and the several face plates 7 constitute first and second terminal members in a main subassembly 3 connecting a power line 5 to a nonillustrated load circuit in the closure position of switch 1.

Figure 2:
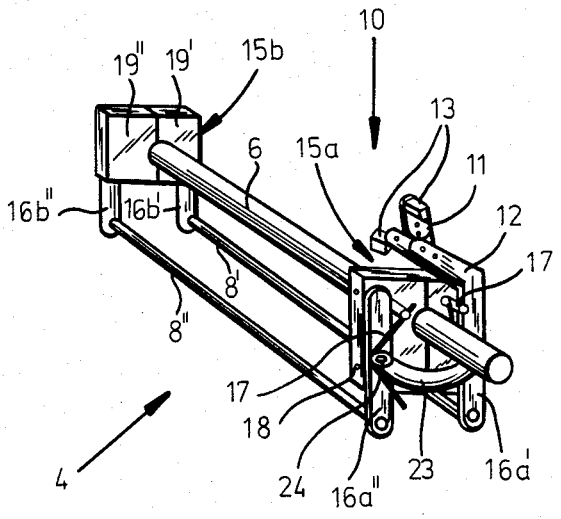
FIG. 2 is a perspective view of a subassembly of the switch.
Figure 3:
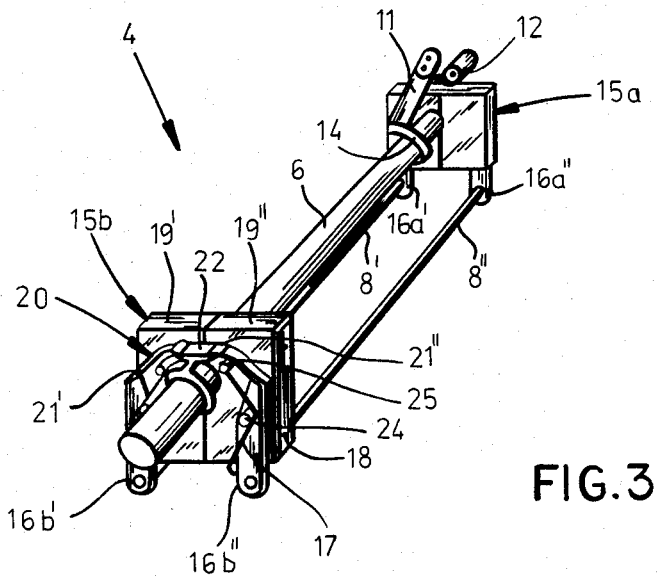
FIG. 3 is a perspective view similar to that of FIG. 2 but showing the subassembly from its opposite end.

An ancillary subassembly 4 comprises a pair of conductive guard elements in the form of slender metallic rods 8', 8'' which extend parallel to the much heavier bar 6 on opposite sides thereof at a level at which they are respectively engageable by face plate 7 on prong 2' and by its nonillustrated mate on prong 2'' before these two face plates come into contact with bar 6 in a switch-closing stroke. The compact subassembly 4 further includes a circuit breaker 10 comprising a pair of conductive spurs 11, 12 which, as more fully described hereinafter with reference to FIGS. 2 and 3, are electrically and mechanically linked with bar 6 and rods 8', 8'', respectively. The two rods are pivotally supported, with the aid of respective pairs of swing arms **16*a'*, 16*a''* and 16*b'*, 16*b''*, on a frame constituted by two brackets 15*a* and 15*b* of dielectric material attached to opposite extremities of bar 6. These extremities are suspended from power line 5 with the aid of conductive hangers comprising respective metal rings 9*a* and 9*b***.

The two insulating mountings **15*a* and 15*b* each comprise a pair of clamping jaws 19', 19'' bolted together by screws 18 as particularly indicated for mounting 15*b*. Each of these jaws carries an outwardly projecting pin 24 about which the respective swing arm 16*a'* etc. is pivotable in a vertical plane perpendicular to bar 6. The two pivot pins supporting arms 16*a'* and 16*a''* are linked by a metallic segment 23 to establish a permanent electrical connection between rods 8' and 8''. A spring wire 17 looped about each pin 24 is anchored at one end to another pin 25 parallel thereto and engages at its other end the respective swing arm to exert thereon a biasing force tending to drive the two rods 8', 8'' apart, i.e. toward the confronting face plates 7 when the switch is open. Spur 11 of circuit breaker 10 is detachably connected by a clamp 14 to bar 6 so as to be in conductive contact therewith; spur 12 forms an integral extension of swing arm 16*a'* and thus forms part of a two-arm lever conductively connected to rods 8' and 8'. Both spurs 11, 12 have tips 13 of scorchproof material contacting each other when circuit breaker 10 is closed, i.e. upon closure of the main subassembly 3 of switch 1**.

FIG. 3 further illustrates a bypass 20 which comprises a pair of resistance elements 21', 21'' that are electrically connected to bar 6 by means of a metallic clamp 22 attached to an extremity thereof at the outer face of bracket **15*b*. The two resistance elements are advantageously designed as tongues of hard rubber or similar elastomeric material of limited resiliency provided with a thin metallic coating or with a filler of metallic particles so as to establish a high-ohmic connection between bar 6 and rods 8', 8'' when the conductive arms 16*b'*, 16*b''*** come into contact with these tongues, upon being swung out from a position much closer to each other than that illustrated in the drawing, when the switch is being opened.

When the prongs 2', 2'' of scissor linkage 2 move toward each other to close the switch, their face plates 7 drive the rods 8', 8'' toward each other against the biasing force of springs 17 whereby arms **16*a''* and 16*b''* will respectively swing counterclockwise and clockwise, as viewed in FIG. 3, to disengage the tongues 21' and 21''. Substantially simultaneously therewith, the spurs 11 and 12 of circuit breaker 10 will come into contact with each other at their tips 13 while the face plates 7 are still spaced from bar 6. Upon the subsequent closure of subassembly 3 facilitated by a certain resiliency of rods 8', 8'' and/or of spur 11, therefore, subassembly 4 is also closed at circuit breaker 10 to carry a minor part of the load current mainly traversing subassembly 3; bypass 20 is cut out in this position. When the scissor linkage 2 is reopened, springs 17 keep the rods 8' and 8'' in contact with the receding face plates 7 until after circuit breaker 10 has opened so that any arcing will occur only between tips 13 of spurs 11, 12. Only thereafter, as the rods 8' and 8'' reach their illustrated spaced-apart position, will these rods be disengaged from face plates 7 to complete the disconnection while the bypass 20** is re-established. The high resistance of this bypass will prevent any arcing between the rods and the face plates even if a potential difference still exists at the instant of their separation.

We claim:

1. In an electrical switch comprising relatively displaceable first and second metallic terminal members engaging each other in a closure position for connecting a power line to a load circuit, the combination therewith of a metallic guard element yieldably interposed between said first and second terminal members for conductive engagement, prior to engagement of said first terminal member, by said second terminal member upon relative motion of said terminal members from a disconnect position into said closure position, and circuit-breaker means inserted between said guard element and said first terminal member for establishing conductive contact therebetween in response to an initial displacement of said guard element by said second terminal member prior to engageent of the latter with said first terminal member, said circuit-breaker means comprising two coacting conductors separating upon reverse motion of said terminal members into said disconnect position after disengagement of said terminal members from each other but before loss of contact between said guard element and said second terminal member.

2. The combination defined in claim 1 wherein said coacting conductors are provided with scorchproof contact zones confronting each other.

3. The combination defined in claim 1, further comprising bypass means in shunt with said circuit-breaker means and mechanically coupled therewith for being cut out upon approach of said closure position and being cut in upon approach of said disconnect position.

4. The combination defined in claim 3 wherein said bypass means establishes a high-ohmic connection between said guard element and said first terminal member upon being cut in.

5. The combination defined in claim 3 wherein said bypass means comprises a first conductive piece rigid with said first terminal member and a second conductive piece movable relatively thereto jointly with said guard element, the latter being provided with biasing means urging same away from said first terminal member into a limiting position in which said conductive pieces are in mutual contact.

6. The combination defined in claim 5 wherein at least one of said conductive pieces consists of metallized elastomeric material of high resistivity.

7. The combination defined in claim 1 wherein said first terminal member is a bar mounted in a frame, said guard element being a rod parallel to said bar and pivotally secured by respective swing arms to opposite ends of said frame, one of said swing arms forming a mechanical and electrical connection between said rod and one of said coacting conductors.

8. The combination defined in claim 7 wherein said second terminal member is one of two substantially identical contactors forming part of a scissor linkage adapted to grip said bar in said closure position, said rod and said swing arms being symmetrically duplicated on opposite sides of said bar.

9. The combination defined in claim 8 wherein said frame comprises two pairs of separable dielectric jaws clamped to opposite extremities of said bar.

10. The combination defined in claim 9 wherein said bar is suspended from said power line by conductive links connected to said extremities.

11. The combination defined in claim 8 wherein the rods on opposite sides of said bar are permanently conductively interconnected.

12. The combination defined in claim 11 wherein said coacting conductors are a first metallic spur rigid with said one of said swing arms and a second metallic spur rigid with said bar, further comprising spring means biasing said spurs away from each other.

13. The combination defined in claim 12 wherein said spurs have confronting contact zones of scorchproof metallic material.

14. The combination defined in claim 12, further comprising a resistance element on said frame electrically connected to said bar and positioned for engagement with another of said swing arms in a limiting swung-out position of said rods coinciding with said disconnect position for establishing a high-ohmic bypass between said rods and said bar substantially concurrently with separation of said spurs.

15. The combination defined in claim 14 wherein said resistance element forms a stop determining said limiting swung-out position.

16. The combination defined in claim 14 wherein said resistance element and said spurs are disposed at opposite ends of said frame.

17. The combination defined in claim 14 wherein said resistance element consists of metallized elastomeric material.

* * * * *